US007011729B2

(12) United States Patent
Strong et al.

(10) Patent No.: US 7,011,729 B2
(45) Date of Patent: Mar. 14, 2006

(54) STARCH AND FIBER MIXTURE FOR PAPERMAKING AND METHODS OF MAKING PAPER WITH THE MIXTURE

(75) Inventors: Philip Strong, Willowbrook, IL (US); Brian Edward Ireland, Albany, NY (US); John Gregory Kinney, Mokena, IL (US)

(73) Assignee: Corn Products International, Inc., Westchester, IL (US)

( * ) Notice: Subject to any disclaimer, the term of this patent is extended or adjusted under 35 U.S.C. 154(b) by 0 days.

(21) Appl. No.: 10/712,699

(22) Filed: Nov. 12, 2003

(65) Prior Publication Data

US 2005/0098288 A1 May 12, 2005

(51) Int. Cl.
*D21H 11/00* (2006.01)

(52) U.S. Cl. ..... 162/176; 162/175; 162/187; 162/186; 162/184; 162/189; 162/190; 162/264; 162/130; 162/149; 162/141; 106/164.1

(58) Field of Classification Search ..... 162/130, 162/149, 176, 175, 187, 186, 184, 189, 190, 162/264; 106/164.01
See application file for complete search history.

(56) References Cited

U.S. PATENT DOCUMENTS

| | | | | |
|---|---|---|---|---|
| 2,197,463 | A * | 4/1940 | Bradner | 162/175 |
| 4,347,100 | A | 8/1982 | Brucato | |
| 4,609,432 | A | 9/1986 | Brucato | |
| 4,889,594 | A | 12/1989 | Gavelin | |
| 5,411,637 | A * | 5/1995 | Glomb et al. | 162/135 |
| 5,449,437 | A * | 9/1995 | Vikio | 162/190 |
| 5,830,364 | A * | 11/1998 | Bleakley | 210/712 |
| 5,942,087 | A | 8/1999 | Pruszynski | |
| 5,997,692 | A * | 12/1999 | Taylor et al. | 162/175 |
| 6,183,596 | B1 * | 2/2001 | Matsuda et al. | 162/9 |
| 6,375,799 | B1 | 4/2002 | Halmschlager et al. | |
| 6,423,181 | B1 | 7/2002 | Mendez-Gallon et al. | |

* cited by examiner

*Primary Examiner*—Mark Halpern
(74) *Attorney, Agent, or Firm*—Norris, McLaughlin & Marcus

(57) ABSTRACT

The invention relates to a starch and fiber mixture, and the application of a starch and fiber mixture in paper manufacturing. The starch and fiber mixture is applied to a paper mat, after the paper mat is formed. The starch and fiber mixture may be obtained by the selective filtering of white water from the papermaking process, particularly by use of a pressure screen.

7 Claims, 2 Drawing Sheets

STARCH AND FIBER MIXTURE FOR PAPERMAKING AND METHODS OF MAKING PAPER WITH THE MIXTURE

BACKGROUND OF THE INVENTION

1. Field of the Invention

The invention relates to the application of a starch and fiber mixture in paper manufacturing. The starch and fiber mixture is applied to a paper mat, after the paper mat is formed. In an embodiment of the invention, the starch and fiber mixture is obtained by the selective filtering of the white water from the papermaking process. The white water is filtered to remove larger particles so that the filtered white water can be used in a spraying process.

2. The Prior Art

Paper and board can be made by a number of processes as known in the art. These processes include the Fourdrinier process, dual former machines, gap former machines and other machines. For example, in the Fourdrinier process, paper and board are generally produced by forming a fiber mat from aqueous cellulosic slurry on a wire screen. These papermaking systems generally comprise a head box having a flow chamber upstream from the wire screen. The head box receives the aqueous cellulosic slurry and deposits the slurry onto the wire screen where a paper mat is formed. The paper mat is removed from the wire screen and further processed, including drying, to form the paper or board.

The aqueous cellulosic slurry generally has a solids content of less than 1% and, therefore, a large amount of liquid is drained off the mat. This liquid is referred to as white water and is a source of fiber. White water comprising fiber is a by-product of most papermaking processes. U.S. Pat. No. 5,942,087 describes the use of fiber from white water that is premixed with granulated starch and then flocculated for use as an additive to paper stock prior to the formation of the paper mat.

We have discovered that a fiber source, including that obtained by white water in a papermaking process, can be sprayed onto the paper mat after its formation to improve the properties of the paper. The fiber source is incorporated into a starch slurry and the resulting starch and fiber mixture is sprayed onto the paper mat. The fiber allows the starch to remain on the mat where it is cooked during further processing. In a preferred embodiment, the white water is selectively filtered, such as in a pressure screen, to obtain optimum sized fiber particles that are capable of being sprayed and will retain the starch on the paper.

In the present Specification, all parts and percentages are on a weight-by-weight basis unless otherwise specified.

SUMMARY OF THE INVENTION

The invention pertains to the addition of a starch and fiber mixture to the papermaking process which improves the dry strength of the paper. The starch and fiber mixture is added to the paper after the paper mat is formed. In a preferred embodiment of the invention, the starch and fiber mixture is sprayed onto the paper mat after the mat exits the head box. The fiber allows the starch to remain on the mat where it is cooked during further processing.

The starch and fiber mixture can be obtained by adding fiber to a starch slurry. For example, a commercial fiber product can be added to the starch slurry to form a mix which is then sprayed onto the fiber mat. In a preferred embodiment, however, the fiber source is the white water from the papermaking process. The white water is selectively screened to remove longer particles that cannot be easily sprayed. The screened white water is then mixed with a starch slurry and sprayed onto the paper mat.

DETAILED DESCRIPTION OF THE INVENTION

Figure 1:
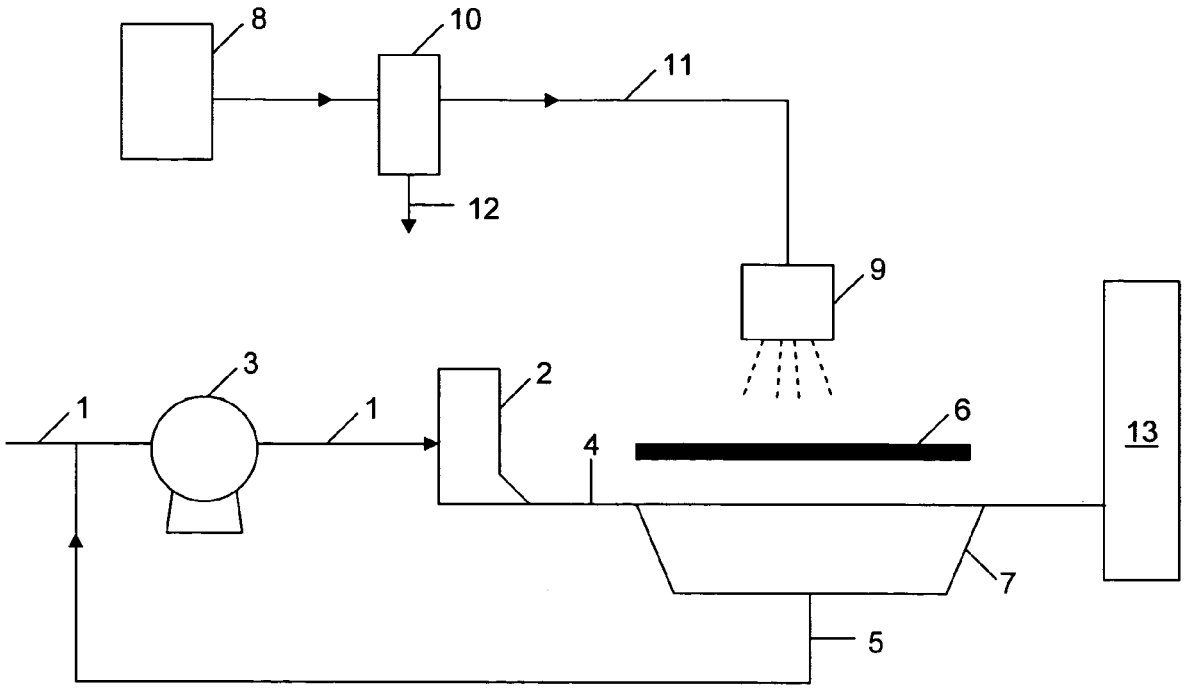
FIG. 1 is a flow chart showing a papermaking process comprising the application of the starch and fiber mixture to a paper mat.

The starch fiber mixture comprises from about 0.01% to about 2.0% fiber and about 0.1% to about 20% starch, preferably about 0.05% to about 0.5% fiber and about 1% to about 10% starch. The starch is in the form of a slurry having a solids content of about 0.1% to about 20%, preferably about 1% to about 10%. The balance of the starch and fiber mixture is generally water, however, the starch and fiber mixture may also comprise additives and fillers.

Any fiber source may be used for the starch and fiber mixture, such as any commercially available fiber or the white water generated through the papermaking process. Corn fiber, such as that available from Corn Products International, Inc., Westchester, Ill., USA ("Corn Products"), under the trademark PEERLESS®, may be used as the fiber source for the starch and fiber mixture. Generally, in spray applications, for example, the fiber should have a size of about ½ of the diameter of the nozzle used to spray the starch and fiber mixture onto the paper mat. The fiber should have a particle size greater than zero and up to about 0.08 inches in length, preferably about 0.02 inches in length to about 0.05 inches in length.

The particle size of the fiber source may be obtained through a filtering process. When white water is used, filtering is generally necessary. We have found that a pressure screen is the most effective means for filtering the white water. The pressure screen separates long fibers and fine fibers in the fiber source. The type and characteristics of pressure screen depends on the type of material being screened and the desired particle size. In the process of the invention, separation of the long and fine fiber without blinding over of the filter medium is desired. Commercially available pressure screens, such as those from FLUID-QUIP®, Springfield, Ohio, USA, like the 120° pressure screen, may be used. The pressure screen can be incorporated into the papermaking process such that the white water from the wire screen is treated in the pressure screen and the accepts from the pressure screen are used to form the starch and fiber mixture, and sprayed onto the paper mat within the process and the rejects from the pressure screen are either recycled or discarded.

Both natural unmodified starch and modified starch can be used for the starch and fiber mixture, each providing equal or about equal performance. Any starch appropriate for use in papermaking may be used and dextrin, as well as combinations of starch types, dextrin types and combinations of starches and dextrins. Also, maltodextrins and other forms of carbohydrates can be used as the starch component.

Unmodified starch is a commodity chemical produced from the root, stem or fruit from a number of plants. It is a high molecular weight carbohydrate polymer which is comprised of linear and branched polysaccharide polymers and it can have moisture content from about 8% to about 20%, most commonly from about 11% to about 13%. Starches such as those derived from corn, wheat, barley, tapioca, rice, potato and/or other suitable plant source, and the like can be used, as well as hybrids. Blends of starches from various sources also can be used. Pearl starches and powdered starches may be used.

Modified starch can be mechanically, chemically or heat modified. Modified starches have different properties than unmodified starch, including differences in solubility, film forming, whiteness, gel strength, viscosity stability, adhesivity, resistance to shear and resistance to freeze-thaw degradation. Starches derived from other genetic forms of corn, such as high amylose and waxy corn, as well as sorghum varieties, would also be suitable. Chemically modified starches useful in the invention include modified oxidized starch such as hypochlorite-oxidized starch, acid thinned starches, cross-bonded starch, etherified starches, esterified-starches and others which have reduced molecular weight, high fluidity and/or functional sub groups. Examples of chemically modified starches which can be used in the invention and are commercially available are SUREBOND® Industrial Corn Starch or STABLEBOND® Industrial Corn Starch available from Corn Products. FOXHEAD® Cationic Starches available from Corn Products and Corn Products' oxidized starch may also be used in the invention.

The starch and fiber mixture can be produced in a remote location from the paper manufacturer, such as being made at a manufacturing facility and sold as a commercial product, or the starch and fiber mixture can be generated at the paper making facility. The starch and fiber being mixed either at a remote location or at the paper manufacturing facility provides a more homogeneous mixture of the starch to the main paper making process, as contrasted with applying starch and fiber separately or in the same process step but without having previously mixed the components. Pre-mixing the starch and fiber can increase the efficiency of the starch to fiber bonding. The pre-mixed fiber can bridge through starch layers formed in sheets to promote more fiber-starch bonding.

Generally, the starch and fiber mixture can be made by adding a fiber source to a starch slurry and mixing so that the starch and fiber are in a homogenous slurry. The starch slurry is made by mixing starch and fiber in sufficient quantities and for sufficient time to thoroughly wet out the starch. The starch slurry and fiber are mixed in any type of mixing apparatus at a temperature of about 32° F. to about 140° F.

A paper making process comprising means for applying the starch and fiber mixture is shown in FIG. 1. A pulp and process water stream 1 is sent to a head box 2 by a first means for circulation 3 such as a pump, and the head box 2 deposits the pulp and process water onto the wire screen 4 where the paper web or mat 6 is formed. The pulp and process water is filtered through the mat forming the white water 5 which is collected in a tray 7 and recycled through the system without or without further processing.

Referring again to FIG. 1, the starch and fiber mixture is made in a mixer 8 and sent to a means 9 for applying the starch and fiber mixture to the paper mat 6. As shown in FIG. 1, the starch and fiber mixture may be sent through a means for separation 10, such as a filter or pressure screen to remove any large particles, e.g., starch contaminants. Filters available from RPA Process Technologies USA, Portage, Mich., USA may be used. The filter must be properly sealed to prevent pressure drop, particularly during the cleaning cycle, to provide continuous flow to the means for applying the starch and fiber mixture to the paper mats, e.g. the spray bar. The accepts 11 from the means for separation 10 are sent to the means 9 for applying the starch and fiber mixture and the rejects 12 are discarded. The starch and fiber mixture is applied to the paper mat 6 after the mat is formed on the wire screen but before the paper mat is further processed, such as drying and pressing (shown graphically as block 13 in FIG. 1).

Figure 2:
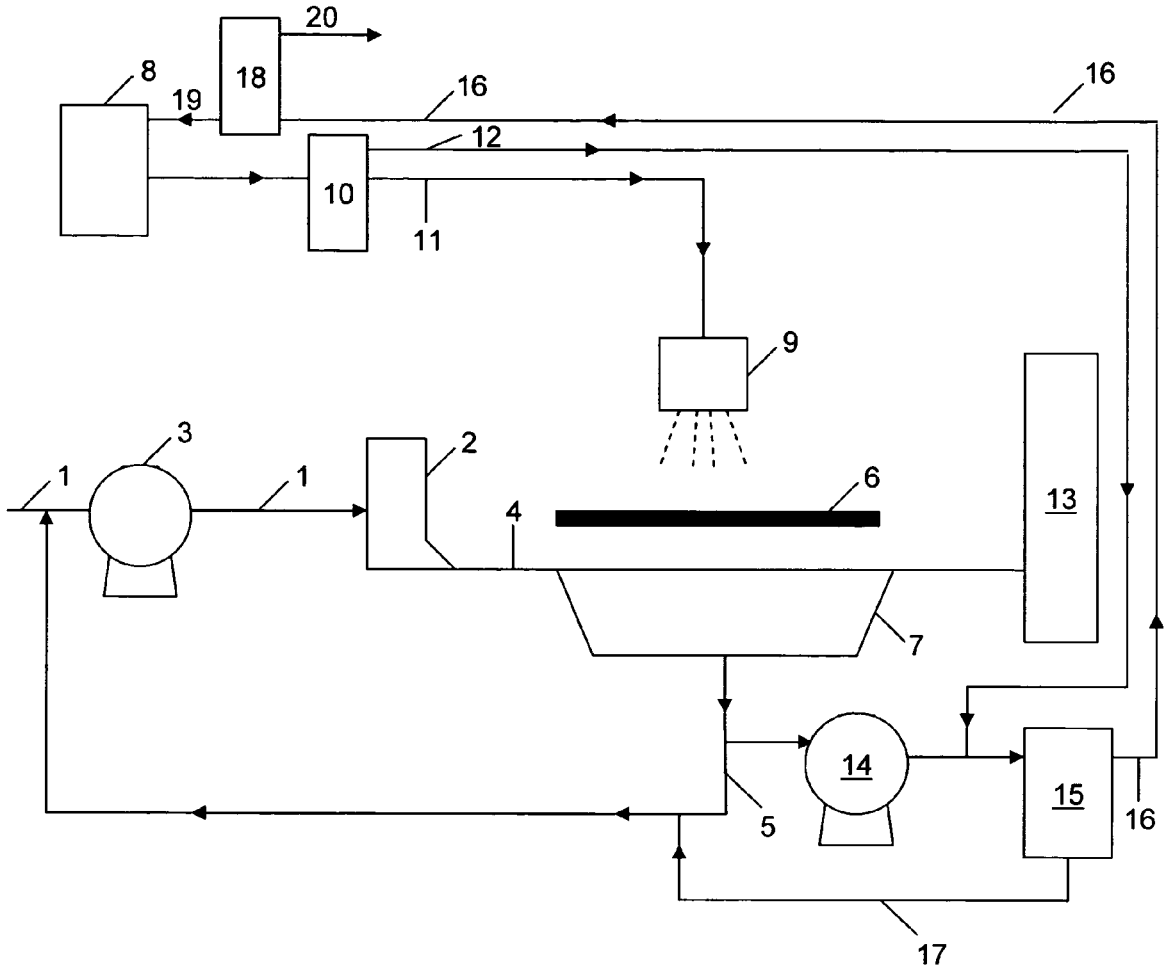
FIG. 2 is a flow chart showing a papermaking process comprising the application of the starch and fiber mixture to a paper mat in an embodiment of the invention wherein white water from the papermaking process is used for the fiber source.

FIG. 2 shows the basic process shown in FIG. 1 but modified to provide for the use of white water in making the starch and fiber mixture. In the embodiment of the invention shown in FIG. 2, all or some white water 5, after leaving the tray 7, is circulated, optionally by a second means for circulation 14, such as a pump, to a pressure screen 15, such as a 120° pressure screen from FLUID-QUIP®. The accepts 16 from the pressure screen are sent to the mixer 8 where the accepts 16 are mixed with starch (e.g. a starch slurry) to form the starch and fiber mixture. The accepts 16 may, optionally, be processed through a second means for separation 18, such as, a filter from RPA Process Technologies, prior to being sent to the mixer 8. In this embodiment, as shown in FIG. 2, the accepts 19 from the second means for separation 18 are sent to the mixer 8 and the rejects 20 from the second means for separation 18 are discarded. As with all other filters in the process, the second means for separation 18 must be properly sealed to prevent pressure drop, particularly during the cleaning cycle, to provide continuous flow to the means for applying the starch and fiber mixture to the paper mats, e.g. the spray bar. The rejects 17 from the pressure screen 15 are either discarded, or, as shown in FIG. 2, re-circulated through the process to be mixed with pulp and then sent to the head box 2. As shown in FIG. 2, the rejects 12 from the means for separation 10 may be circulated through the pressure screen 15, which provides further economy in raw materials in the process of the invention. A portion of the white water 5 is also recycled into the process.

The ability to use white water for the starch and fiber mixture reduces the cost of fresh water, the cost of wastewater treatment, and allows for greater efficiency in fiber use. Further, the ability to use process water or a starch source and white water or a fiber source allows for introduction and synergy of fibers within the starch and fiber mixture.

In FIGS. 1 and 2, spraying is depicted as the means 9 for applying the starch and fiber mixture to the paper mat 6, however, any appropriate means may be used including spray bars, curtain coaters, size presses, and the like. Also, the starch and fiber mixture can be used with any type of paper making process, such as dual former machines, gap former machines and other machines in addition to the Fourdrinier processes illustrated in FIGS. 1 and 2.

In traditional spraying systems, as well as with spray bars, curtain coaters, size presses, and the like, conventional wisdom says that the cleaner the water you are using, the better your system will work. Generally, if the source water for a system is contaminated with fiber, the fiber will eventually collect and foul the device, such as plugging some or all of the spray nozzles in a spraying apparatus or spray bar. The selective filtration of the white water, such as through a pressure screen, alleviates the drawbacks associated with fiber containing water yet retains the advantages derived from introducing fine fibers with raw starch into the wet end of the paper machine.

The ability to use the starch and fiber mixture after the formation of the paper mat yields numerous benefits in paper processing. These include the ability to reduce or eliminate chemicals, such as flocculants, from the paper because the mixture can be made without flocculating the starch. In conventional systems, chemicals become part of the paper and represent in a cost for making the paper. The process of the invention also requires much less equipment than in traditional systems because there is no need for chemical modification or special handling. Also, in the embodiment of the invention wherein the white water is used, waste is put to beneficial use instead of requiring disposal.

EXAMPLE 1

A full width spray bar was attached to the Fourdrinier of #2 Paper Machine above the base ply prior to the dry line. The spray nozzles were angled slightly toward the dry end of the paper machine to help minimize any misting of starch that can lead to excessive build-up of starch on the bar and in the surrounding area.

A fiber and starch slurry was made by combining starch and white water that has been screened to remove long fiber, using a 120° pressure screen from FLUID-QUIP®, to about 30% solids. As the starch was being pumped to the spray bar, it was diluted, with screened white water, to a desired solids (the target varied from 7.1% to 7.8% as production rates changed) to control the application rate to approximately 80 pounds/ton (4% add on). The back pressure valve on the spray bar was set at 40 psi to insure a consistent flow rate which was 52.5 gallons per minute ("gpm"). For some of the test runs, starch add on was performed by spraying a layer of starch on the top of the bottom ply of a two ply sheet.

The paper produced prior to, during, and after the evaluation was tested for Mullen, conditioned Mullen, conditioned Ring Crush, and Scott bond, applying Technical Association of the Pulp and Paper Industry ("TAPPI") standards. The test data from the paper produced prior to and after the evaluation were recorded as the baseline data for comparison to the paper made with starch and fiber mixture sprayed onto the base ply. After an initial increase in Mullen was observed, the Basis Weight for the 42# Liner Board was lowered from 44 pounds to 41 pounds for two reels. Also, two reels of 35# Liner Board were made using 80 pounds per ton of spray starch without the use of Hercubond dry strength resin.

The table below shows the data generated during the evaluation. The data shows that the starch and fiber mixture sprayed onto the base ply has an immediate impact on both Mullen and Scott Bond. The Mullen Index (Unconditioned Mullen divided by the Basis Weight) on average as 11.3% greater with the addition of starch.

| Sample | Basis Weight | Starch add on lbs/ton | Unconditioned Mullen | Mullen Index | Conditioned Mullen | Ring Crush | Scott Bond |
|---|---|---|---|---|---|---|---|
| 1-A | 44.78 | 0 | 94.6 | 2.113 | 97.3 | 84.4 | 200 |
| 1-B | 43.29 | 0 | 96.9 | 2.238 | 96.9 | 86.9 | 147 |
| 1-C | 44.62 | 80 | 106.1 | 2.378 | 108.6 | 91.6 | 250+ |
| l-D | 44.89 | 80 | 105.6 | 2.352 | 109.2 | 92.3 | 250+ |
| 1-E | 42.29 | 80 | 106.1 | 2.509 | 108.5 | 87 | 250+ |
| 1-F | 40.64 | 80 | 100.9 | 2.483 | 102.9 | 85.4 | 250+ |
| 1-G | 41.59 | 80 | 103.9 | 2.498 | | | |
| 1-H | 44.06 | 80 | 111.1 | 2.522 | 118.9 | 83.9 | 250+ |
| 1-I | 43.45 | 0 | 96.6 | 2.223 | | | |
| 2-A | 44.10 | 0 | 104.0 | 2.358 | | 85.1 | 140 |
| 2-B | 43.88 | 0 | 103.3 | 2.354 | | | |
| 2-C | 43.91 | 0 | 101.5 | 2.312 | 106.3 | 88.84 | 135 |
| 2-D | 44.56 | 80 | 116.0 | 2.603 | 121.1 | 85.82 | 250+ |
| 2-E | 40.47 | 80 | 104.1 | 2.572 | 110.2 | 86 | 250+ |
| 2-F | 38.71 | 80 | 101.1 | 2.612 | 102.7 | 83.91 | 250+ |
| 2-G | 37.60 | 80 | 100.5 | 2.673 | 101.6 | 70.31 | |
| 2-H | 41.30 | 0 | 93.0 | 2.252 | 95.1 | 79.72 | 167 |

Samples 2-A and 2-D were cut to fit molds. The samples were then immersed in an acrylic polymer solution of methacrylate and benzoyl peroxide and cured overnight. Samples were sectioned at 10 microns thick with a rotary microtome and put on microscope slides. Supporting acrylic surrounding the sample was removed with xylenes. Samples free of acrylic were iodine stained and air-dried. Slides were mounted with PERMOUNT® solution (from Fisher Scientific Company, Pittsburg, Pa. USA) for protection and preservation. Finished samples were examined under an OLYMPUS® BH-2 microscope and photographed with a POLAROID® Digital Camera.

The samples were photographed at 10 times magnification under the microscope. The photographs reveal starch in the samples and the starch is gelatinized.

We claim:

1. A paper making process comprising the steps of a. forming a paper mat by sending pulp and process water to a head box and having the pulp and process water deposited from the head box onto a wire screen, and b. providing a mixture in the form of a slurry comprising starch from about 0.1% to about 20% by weight of the slurry, and fiber from about 0.01% to about 2.0% by weight of the slurry, and applying the starch and fiber mixture to the paper mat, and c. removing the paper mat from the wire screen, and d. having the paper mat further processed to obtain paper wherein the pulp and process water is filtered through the paper mat to form white water which is removed from the wire screen and moved into a pressure screen that obtains accepts and rejects and the starch and fiber mixture comprises the accepts.

2. The process of claim 1 wherein the starch and fiber mixture is applied to the paper mat after the paper mat is removed from the wire screen but before the further processing.

3. The process of claim 1 wherein the pressure screen is a 120° pressure screen.

4. The process of claim 1 wherein the accepts comprise fiber having a particle size, in length, greater than zero and up to about 0.08 inches.

5. The process of claim 1 wherein the paper mat is heated and the starch is cooked.

6. The process of claim 1 wherein the starch and fiber mixture is applied to the paper mat by means selected from the group consisting of spray bars, curtain coaters and size presses.

7. The process of claim 1 wherein the starch and fiber mixture is diluted prior to application of the starch and fiber mixture to the paper mat.

* * * * *

UNITED STATES PATENT AND TRADEMARK OFFICE

CERTIFICATE OF CORRECTION

PATENT NO. : 7,011,729 B2
APPLICATION NO. : 10/712699
DATED : March 14, 2006
INVENTOR(S) : Strong et al.

It is certified that error appears in the above-identified patent and that said Letters Patent is hereby corrected as shown below:

Column 6, Line 53, "mixture to the paper mat" should read -- mixture to the formed paper mat --

Signed and Sealed this

Seventh Day of November, 2006

JON W. DUDAS
*Director of the United States Patent and Trademark Office*